United States Patent [19]

Struve et al.

[11] Patent Number: 4,487,526

[45] Date of Patent: Dec. 11, 1984

[54] METHOD OF AND STRUCTURE FOR ERECTING AN ARTIFICIAL ISLAND

[75] Inventors: Timm Struve; Harald Neumann, both of Hamburg, Fed. Rep. of Germany

[73] Assignee: Dyckerhoff & Widmann Aktiengesellschaft, Munich, Fed. Rep. of Germany

[21] Appl. No.: 464,999

[22] Filed: Feb. 8, 1983

[30] Foreign Application Priority Data

Feb. 17, 1982 [DE] Fed. Rep. of Germany ..... 3205561

[51] Int. Cl.[3] ..... E02B 17/08; E02D 21/00; E02D 29/06

[52] U.S. Cl. ..... 405/196; 405/203; 405/222; 249/10

[58] Field of Search ..... 405/195–197, 405/203–205, 207–209, 222, 223, 169, 170, 189, 194; 249/1, 10, 11, 144; 52/123.1, 125.1

[56] References Cited

U.S. PATENT DOCUMENTS

| | | | |
|---|---|---|---|
| 2,029,004 | 1/1936 | Varni | 405/223 X |
| 2,673,065 | 3/1954 | Patterson | 405/196 X |
| 3,354,659 | 11/1967 | Lehmann | 405/223 X |
| 4,268,191 | 5/1981 | Tuson | 405/189 X |
| 4,345,854 | 8/1982 | Valantin | 405/170 X |

FOREIGN PATENT DOCUMENTS

| | | | |
|---|---|---|---|
| 1567628 | 5/1980 | United Kingdom | 405/196 |

*Primary Examiner*—Cornelius J. Husar
*Assistant Examiner*—Nancy J. Stodola
*Attorney, Agent, or Firm*—Toren, McGeady and Stanger

[57] ABSTRACT

An artificial island located on the high sea is formed of a support structure and a platform mounted on the upper end of the support structure. During erection, the support structure, not completed for its full height, is moved into position and founded on the ocean floor. The platform is floated into position and mounted on the upper end of the support structure. The height of the support structure is then extended until the final height is reached. During the completion of the upper end of the support structure, the platform is lifted so that it remains on top of the support structure. A housing is provided around the upper end of the support structure so that it can be sealed from the environment for completing the construction of the upper end of the support structure.

18 Claims, 5 Drawing Figures

FIG. 1
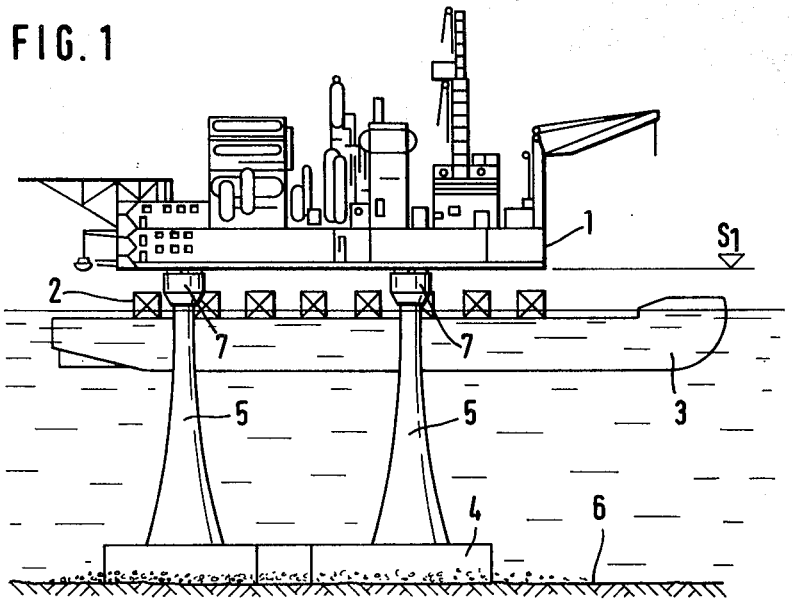
FIG. 2a
FIG. 2b
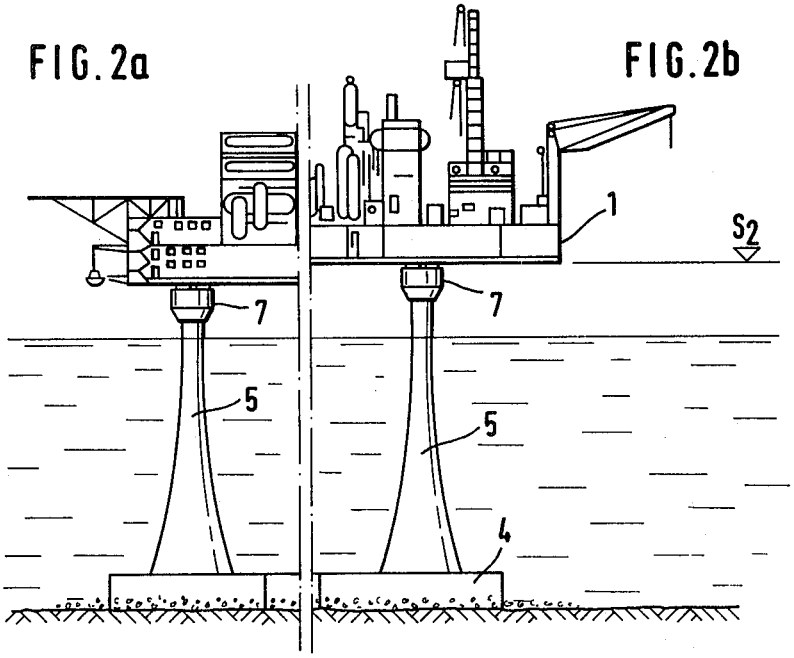

METHOD OF AND STRUCTURE FOR ERECTING AN ARTIFICIAL ISLAND

SUMMARY OF THE INVENTION

The present invention is directed to a method of erecting an artificial island in which, initially, the support structure is positioned on the ocean floor. The support structure is formed of reinforced concrete or prestressed concrete and when placed on the ocean floor its upper end extends only slightly above the level of the sea. Subsequently, the platform is floated into position and placed on the upper ends of the supports so that it is located above sea level.

To avoid the difficulties which might occur during the assembly of an artificial island at a location on the high sea, it was known to construct the support structure and the foundation separately from the platform, and to transport them separately to the location of the artificial island. After lowering the support structure onto the ocean floor, the platform, transported on a float, was placed on the lower partial sections of the supports which extend slightly above sea level. The upper partial sections of the supports were incorporated into the platform and they were connected with the lower partial sections by means of coupling elements.

In its final height, the platform must be located at a distance sufficiently above sea level so that water does not wash over the platform during stormy weather or a heavy sea. Accordingly, the platform, on the float on which it is transported, must be located at a higher position than its final height if it is to be lowered onto the sections of the support projecting above sea level. In spite of the location of the coupling elements, it is very difficult to guarantee a stable position during floating for the combination of the platform, the sections of the support and the float.

Therefore, the primary object of the present invention is to provide a method of erecting an artificial island of the type described above so that there is increased safety and greater independence of weather conditions.

In accordance with the present invention, after the platform is lowered onto bearings located at the upper ends of the support, the support structure is completed to its final height and during such construction the platform is lifted.

In accordance with the method embodying the present invention, the platform on the float can be transported at a height significantly lower than the final height of the platform and, at the same time, it can be lowered when it is placed on the support structure onto the upper ends of such structure which are located above sea level. Accordingly, no special precautions are needed to assure the floating stability of the combined platform and float. Using known construction operations, the support structue can be completed in sections and, at the same time, the platform can be raised until it reaches the desired height of approximately 15 to 25 meters above sea level.

Although the upper ends of the support structure project above sea level when the platform is being lowered on to it, the possibility of bad weather must be taken into account as well as wave activity which could extend over a considerable period during the erection of the support structure, and such conditions may impair the construction work on the upper ends of the support structure which is in any case difficult and dangerous.

Therefore, another feature of the present invention is to provide the possibility to carry out the raising of the upper ends of the support structure independently of the weather and any wave activity.

In accordance with the present invention, the work area at the top of the support structure is enclosed by a housing erected in accordance with the construction progress of the structure and it is sealed at its lower end with respect to the outer wall of the support and at its upper end relative to the platform, when the platform is set in position.

The housing surrounding the upper end of the support structure includes a cover plate which rests at its underside on lifting devices arranged at the upper end of the support structure and at its upper side mounts bearings for the support of the platform. Advantageously, these bearings are used as the final bearings for the platform.

The cover plate may have an opening in its central area.

In a preferred arrangement, an upwardly extending circular edge wall is provided on the upper side of the cover plate providing a protected space for the bearings.

Another preferred feature is the provision of a frustoconical section at the lower end of the housing tapering inwardly toward the support. Devices may be incorporated into the housing for supporting it in the radial direction relative to the support structure.

Inflatable sealing hoses can be arranged to seal the gaps between the support and the housing or between the housing and the platform. The sealing hose for the gap between the housing and the platform is preferably arranged on the upper end of a wall encircling the upper side of the cover plate.

Advantageously, the housing is constructed of reinforced concrete and, after the completion of the support structure, it becomes a part of the structure.

The hollow space within the housing which forms the work area at the top of the support can be filled with concrete when the support structure is completed.

As a result, the work area at the upper end of the support structure can be tightly enclosed by the housing erected during the course of the construction of the support structure so that the housing protects the work area from any adverse weather conditions. The housing is movably positionable along the support and, accordingly, a gap is formed between the housing and the support. Another gap is provided between the underside of the platform and the top of the housing. Both of these gaps are sealed so that the work area enclosed by the housing is completely protected from any environmental influences and the construction work in the support structure can be continued not only when water flows around the housing, but also when the housing is completely or partially immersed in water.

It is particularly advantageous if the housing, as well as the support structure, is constructed of reinforced concrete or prestressed concrete and includes a cover plate suitable for transferring the bearing pressures of the platform by means of the bearings onto lifting devices. Preferably the bearings form the final bearings for the platform and hydraulic jacks are used as the lifting devices for the platform. When the support structure is completed, the housing may become a part of the completed structure.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

BRIEF DESCRIPTION OF THE DRAWING

In the drawing:

FIG. 1 is an elevational view showing the lowering of the platform onto the support structure which is not yet completed;

Figure 3:
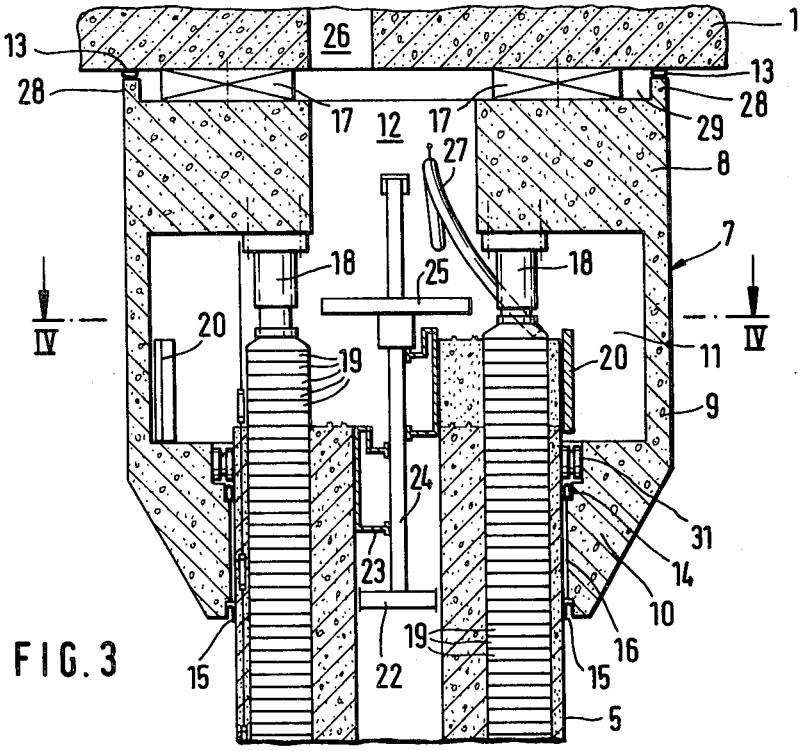
Figure 4:
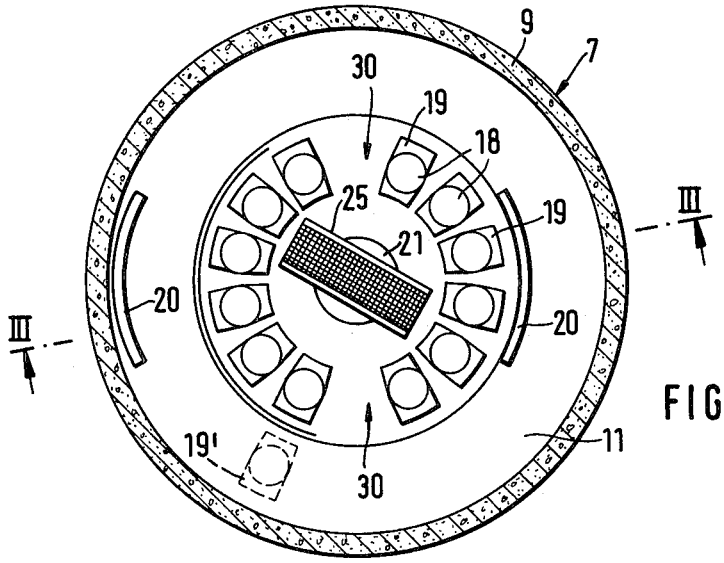

FIG. *2a* is a view similar to FIG. 1 showing a portion of the platform being lifted;

FIG. *2b* is a view similar to FIG. *2a*, however, the platform is shown in the final position;

FIG. 3 is a vertical section taken along the line III—III in FIG. 4 and illustrating the area in the upper end of the support structure while the support is being erected; and FIG. 4 is a horizontal section taken along the line IV—IV in FIG. 3.

DETAILED DESCRIPTION OF THE INVENTION

In FIG. 1 a platform 1 is shown which was constructed at a land site or a water site near land complete with its mounting equipment. The platform was placed on a number of tubular steel towers 2 located on a pontoon 3. The pontoon 3 with the platform mounted on it was towed to the location shown in FIG. 1 by an ocean-going tugboat. A support structure formed of a foundation 4 and supports 5, also transported to the illustrated location, has already been placed on the ocean floor. The foundation 4 and the supports 5 are constructed of reinforced concrete or prestressed concrete. The supports 5 extend upwardly through the water to the level $S_1$ slightly above sea level. The pontoon 3 is positioned adjacent the supports 5 and, by ballasting the pontoon, the platform 1 is slowly lowered onto the upper ends of the supports 5. With the platform supported on the upper ends of the supports 5, the tubular steel towers 2 are released from the platform and the pontoon 3 can be moved away from the support structure. In FIG. 1, the pontoon 3 is shown in the lowered position ready to be moved away from the support structure.

As viewed in FIG. 1, the upper ends of the supports 5 have not been completed, that is, the upper ends of the supports must be raised to the final position of the platform. At the head or upper end of each support 5, a housing is provided which encloses a work area so that the continued construction of the supports and the lifting of the platform can be carried out. The housing 7 can be installed on the supports 5 at the original construction site where the supports are built along with the foundation 4. Accordingly, when the platform is placed on the upper ends of the supports 5 the continued construction of the supports and the lifting of the platform can go forward immediately.

FIG. *2a* illustrates an intermediate stage in the lifting of the platform 1. In FIG. *2b*, the platform has been lifted to its final height $S_2$. In the final position of the support structure shown in FIG. *2b*, the housing 7 has become a part of the support 5.

In FIGS. 3 and 4 an enlarged detail showing is provided of the housing 7 enclosing a work area at the upper end or head of the support 5.

Housing 7 located around the upper end of support 5 is approximately cylindrically shaped and is constructed of reinforced concrete. As an alternative, a reinforced structural steel member could be used as the housing. At its upper end, a cover plate 8 extends across the housing 7 and is connected at its outer circumferential periphery to a downwardly extending housing wall 9. The housing wall 9 is dimensioned to resist wave impact and at its lower end continues in an increased thickness ring 10 having an approximately triangular cross-section. Accordingly, the ring 10 forming the lower end of the otherwise cylindrically shaped housing has a frustoconical shape which is more favorable for resisting wave impact.

In this arrangement of the housing 7, a hollow or open space 11 is formed within its interior and another hollow space 12 is formed through the cover plate 8 connecting to a central opening 26 located in the underside of the platform. Accordingly, access is available to the spaces 11 and 12 for carrying out the work of increasing the height of the supports 5. The open spaces 11 and 12 are sealed relative to the underside of the platform 1 by a sealing hose 13 and between the ring 10 and the outer surface of the support 5 by a sealing hose 14 spaced intermediate the height of the ring. The sealing hoses 13, 14 are inflatable. Further, at the lower end of the ring 10, a lip seal 15 is provided so that as the housing 7 slides upwardly along the outer surface of the support 5 when the platform is being lifted, the lip seal forms a first seal against the penetration of water into the gap 16 between the housing and the support 5.

Platform 1 rests on bearings 17 which, in turn, rest on the upper side of the cover plate 8. A circular edge wall 28 extends upwardly from the upper side of the cover plate and rings the top of the housing. The edge wall 28 defines the radially outer surface of a chamber 29 extending between the upper side of the cover plate 8 and the underside of the platform 1. Sealing hose 13 rests on the upper surface of the edge wall 28 and contacts the underside of the platform 1. The bearings 17 are located within chamber 29 and are protected in this space. The underside of the cover plate 8 bears on hydraulic jacks 18 and, in turn, the lower ends of the jacks are supported on stacks of prefabricated concrete parts 19 embedded in the annular cross-section of the support 5. The jacks are supported within the space 11 and are secured so that the prefabricated parts 19 can be inserted one on top of the other in the support 5. The arrangement of the hydraulic jacks 18 and the parts 19 is shown in FIG. 4. The arrangement is such that passages 30 for personnel and material is provided between the jacks and the inside of the support 5.

Since the hydraulic jacks 18 can be directly supported on the prefabricated concrete parts 19, the lifting load is carried directly by the parts and the platform 1 can be lifted without waiting for the concrete to set which is poured around the uppermost concrete parts 19. The concrete surrounding the stacks of prefabricated concrete parts 19 merely serves a stabilizing function. During the lifting operation all of the hydraulic jacks are moved at the same time and the platform is lifted under the interposition of the cover plate 8 of the housing. The jacks 18 can be released successively, moved in order to insert additional prefabricated concrete parts 19, and then restressed. When additional concrete parts 19 have been supplied under each of the jacks 18, the next lifting step can be effected. As shown in FIG. 4, in the space 11 radially outwardly from the support 5, additional prefabricated parts 19' are stored for subsequent use.

To perform the work required to increase the height of the supports 5, the placement of the reinforcing steel for the concrete, and the installation of the prefabricated concrete parts 19, the hollow space 11 within the housing 7 is accessible. As is shown in FIG. 3, outer formwork sections 20 for the outer surface of the supports 5 are stored in the radially outer part of the space 11. The formwork sections 20 are portable and can be moved inwardly when a section of the support is to be poured. On the right-hand side of FIGS. 3 and 4 the formwork sections 20 are shown against the outer surface of the support 5 while in the left-hand side of the two figures the formwork sections 20 are shown along the outer surface of the space 11. A hollow space 21 is located within the support 5 and a scaffold 22 is supported in this space. Scaffold 22 includes inner formwork parts 23 which can be moved in the vertical direction. The scaffold also includes a central mast 24 on which a rotary working platform 25 is positioned so that it can be raised and lowered. Working platform 25 is accessible and the material introduced into the space 11 through the opening 26 in the platform can be handled by this platform. A concrete pump line 27 serves to feed concrete into the annular space within the formwork.

To adjust and secure the housing 7 in the horizontal direction relative to the support 5, hydraulic jacks 31 are located in recesses within the upper inner portion of the ring 10 so that the housing can be braced in the radial direction with respect to the support 5.

Housing 7 as well as the support 5 is constructed of reinforced concrete, and when the support 5 is completed to the required height, the housing 7 can remain in this final position and become part of the support structure. Work spaces 11 and 12 may be left open as accessible control spaces or they may be filled with concrete. In any case, the bearings 17 form the final bearings for the platform 1.

While specific embodiments of the invention have been shown and described in detail to illustrate the application of the inventive principles, it wll be understood that the invention may be embodied otherwise without deparating from such principles.

We claim:

1. A method of erecting an artificial island at a location on the ocean floor on the high sea where the sea rises to a level above the ocean floor, with the artificial island including an upwardly extending support structure and a platform mounted on the support structure, comprising the steps of constructing the support structure of at least one of reinforced concrete and prestressed concrete, placing the support structue on the ocean floor with the upper end of the support structure located slightly above the level of the sea, transporting the platform by a float member to the location of the support structure, positioning the platform on the upper end of the support structure, after the platform has been supported on the support structure, increasing the height of the support structure to a final height spaced upwardly from the level of the sea and at the same time lifting the platform so that it remains on the upper end of the support structure, and increasing the height of the support structure by providing an enclosed working space at the upper end of the support structure and utilizing the support structure forming the enclosed working space for supporting the platform, placing prefabricated concrete members on the upper end of the support structure for increasing its height, and jacking the platform upwardly off the prefabricated concrete members.

2. A method, as set forth in claim 1, including using a submersible float member for lowering the platform onto the upper ends of the support structure.

3. A method, as set forth in claim 1, including pouring concrete around the prefabricated concrete members.

4. A method, as set forth in claim 3, including the step of placing movable forms within the work space for forming the support structure.

5. A support structure arrangement for an artificial island to be positioned on the ocean floor at a location on the high sea comprising at least one upwardly extending support and a platform mounted on the upper end of said support, said support structure arrangement arranged for use in lifting the platform to a final height position and for increasing the height of said support wherein said support has a lower end arranged to be founded on the ocean floor and an upper end, an upwardly movable housing laterally enclosing the upper end of said support and extending upwardly therefrom, said housing having a lower end extending laterally around said support and an upper end for supporting said platform, means for sealing the lower end of said housing relative to said support and for sealing the upper end of said housing relative to said platform, said support is a tubular member comprising an annular wall and an axially extending open space within said wall, and said support includes a plurality of prefabricated concrete parts for forming a direct support for said housing and, in turn, for supporting said platform.

6. A support structure arrangement for an artificial island to be positioned on the ocean floor at a location on the high sea comprising at least one upwardly extending support and a platform mounted on the upper end of said support, said support structure arrangement arranged for use in lifting the platform to a final height position and for increasing the height of said support wherein said support has a lower end arranged to be founded on the ocean floor and an upper end, an upwardly movable housing laterally enclosing the upper end of said support and extending upwardly therefrom, said housing having a lower end extending laterally around said support and an upper end for supporting said platform, means for sealing the lower end of said housing relative to said support and for sealing the upper end of said housing relative to said platform, said housing at the upper end thereof above the upper end of said support has a transversely extending cover plate, lifting devices located within said housing and in contact with the underside of said cover plate, said lifting devices arranged to be supported on said support for lifting the platform, and bearings located on the upper side of said cover plate for supporting the platform, and said lifting devices include a plurality of hydraulic jacks each arranged to operated separately for increasing the height of said support and for cooperating as a group for lifting said housing relative to said support and, at the saem time lifting said platform supported on the upper end of said housing.

7. A support structure arrangement, as set forth in claim 5, wherein said housing at the upper end thereof above the upper end of said support has a transversely extending cover plate, lifting devices located within said housing and in contact with the underside of said cover plate, said lifting devices arranged to be supported on said support for lifting the platform, and bearings located on the upper side of said cover plate for supporting the platform.

8. A support structure arrangement, as set forth in claim 5 or 6, wherein said bearings form the final bearing support for the platform when the platform is in the final height position.

9. A support structure arrangement, as set forth in claim 7, wherein said housing forms an open space below said cover plate in which the upper end of said support is accessible and said cover plate has an opening therethrough for access to the open space in said housing.

10. A support structure arrangement, as set forth in claim 9 or 6, wherein said cover plate includes a circular edge wall extending upwardly from and encircling the circumferential edge of said cover plate, said edge wall defining the outer boundary of a space on the upper side of said cover plate containing said bearings.

11. A support structure arrangement, as set forth in claim 5 or 6, wherein said housing has an outer surface comprising an upper cylindrically shaped surface and a frusto-conically shaped surface extending downwardly from the lower end of said cylindrical surface with said frusto-conical surface tapering inwardly toward the outer surface of said support.

12. A support structure arrangement, as set forth in claim 11, including devices located within said housing in the axially extending region of said frusto-conical surface and arranged to extend between the inside of said housing and the outer surface of said support for radially bracing said housing on said support.

13. A support structure arrangement, as set forth in claim 10, wherein said housing is spaced outwardly relative to the outer surface of said support and below the underside of said platform, and said sealing means comprises an inflatable sealing hose located between the inside surface of said housing and the juxtaposed outer surface of said support and another sealing hose located between the upper surface of said housing about the circumferential edge thereof and the underside of said platform.

14. A support structure arrangement, as set forth in claim 13, wherein said sealing hose between said housing and said platform is located on the top surface of said edge wall extending around the upper end of said housing.

15. A support structure arrangement, as set forth in claim 5 or 6, wherein said housing is formed of reinforced concrete and, after the completion of said support, said housing is connected to said support as a part thereof.

16. A support structure arrangement, as set forth in claim 11, wherein the open space within said housing is filled with concrete when said platform is located in the final height position.

17. A support structure arrangement, as set forth in claim 5 or 6, including a support scaffold located within and axially movable within the open space within said annular wall of said support, and said scaffold including a working platform located within the open space in said housing.

18. A support structure arrangement, as set forth in claim 5 or 6, including form sections located within the open space in said housing for forming the radially inner and radially outer surface of said annular wall of said support.

* * * * *